United States Patent [19]

Davis et al.

[11] 4,098,007

[45] Jul. 4, 1978

[54] DRYING OVEN CONTROLLER

[75] Inventors: William Ross Davis; Charles E. Willbanks, both of Spartanburg, S.C.

[73] Assignee: Milliken Research Corporation, Spartanburg, S.C.

[21] Appl. No.: 804,302

[22] Filed: Jun. 7, 1977

[51] Int. Cl.[2] ..... F26B 21/06

[52] U.S. Cl. ..... 34/72; 34/43; 34/50; 432/72

[58] Field of Search ..... 34/43, 50, 72; 432/72

[56] References Cited

U.S. PATENT DOCUMENTS

| | | | |
|---|---|---|---|
| 3,314,159 | 4/1967 | Betz | 34/72 |
| 3,725,532 | 4/1973 | Feruoudes | 34/72 |
| 3,757,427 | 9/1973 | Wilkinson | 34/72 X |
| 3,909,953 | 10/1975 | Hemsath | 34/72 X |

*Primary Examiner*—Harold W. Weakley
*Attorney, Agent, or Firm*—Robert S. Alexander; H. William Petry

[57] ABSTRACT

A device for controlling the rate at which air is exhausted from a textile drying oven including means for withdrawing gas from the interior of the oven, a heater for heating the withdrawn gas, a catalyst bed for combusting the heated gas, a differential thermocouple for measuring the difference in the temperature between the gas entering the catalyst bed and the gas leaving the catalyst bed and means for varying the rate of exhaust from the oven in response to variations in the temperature difference across the catalyst bed.

5 Claims, 1 Drawing Figure

DRYING OVEN CONTROLLER

Figure 1:
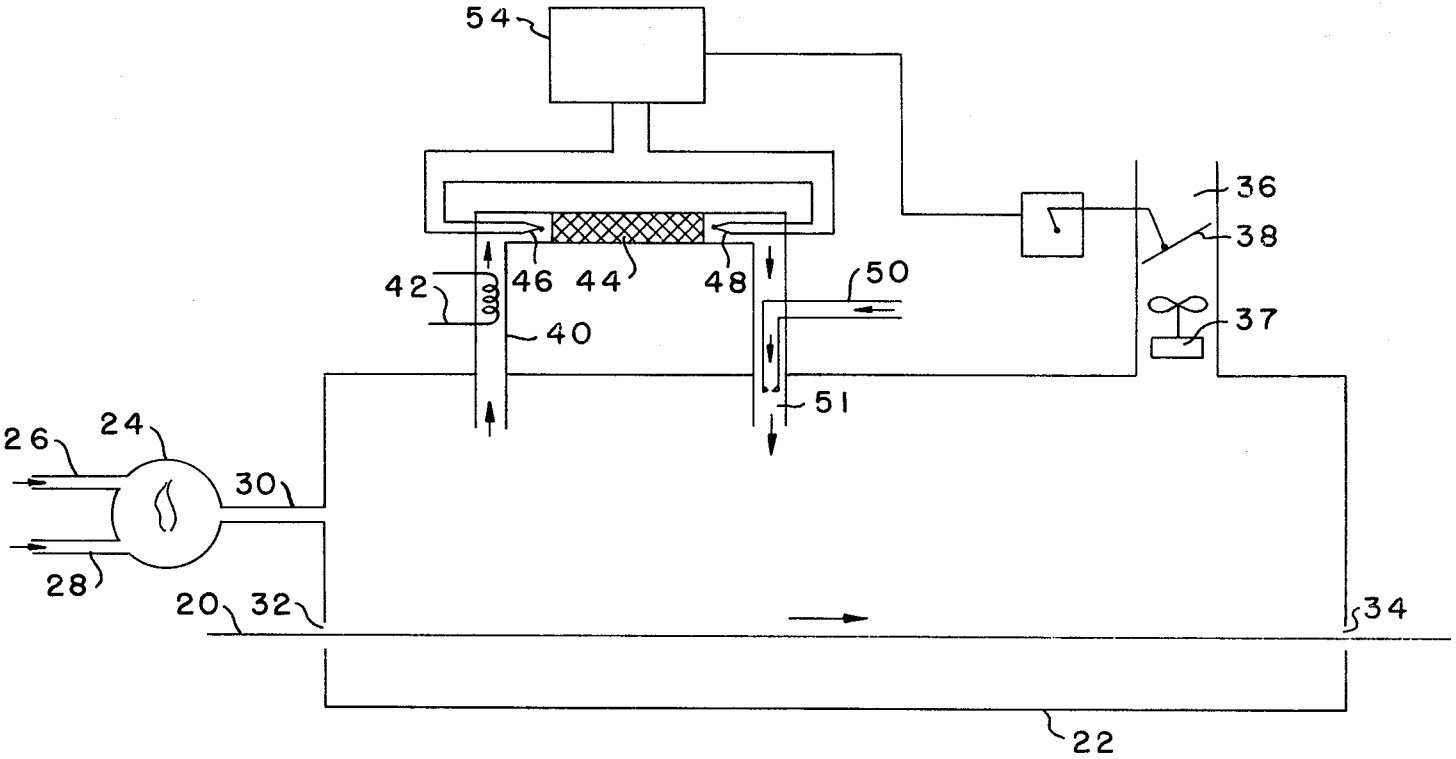

When textile materials which have been treated with organic materials are dried in an oven, the organics are driven off as vapors and should be exhausted out of the building to prevent an undesirable accumulation of organic vapors in the room in which the drying oven is located. Usually, means are provided for drawing air into the oven through the fabric entrance and exit slots and exhausting it through a duct outside of the building. By this means, it is possible to minimize the amount of organic vapors which escape through the fabric entrance and exit slots. However, the rate at which air should be exhausted depends upon the amount of organics in the fabric which is being dried, and the amount of organic material in the fabric varies widely. Fabrics which have been redyed may contain hydrocarbons in an amount equal 10% of the weight of the fabric while other materials may contain much smaller amounts of organic materials. The amount of energy consumed by the oven is determined by many factors, but the rate of flow of air through the oven is one of the most important. Therefore, it is desirable to minimize the rate at which air is exhausted from the oven, while maintaining the rate of discharge of organics into the room at an acceptable level.

The object of the present invention is to provide a device for controlling the rate of flow of air through the oven in response to the amount of organic material in the fabric. By doing so, it is possible to minimize the consumption of energy of the oven when fabrics containing only small amounts of organic material are being dried while preventing excessive escape of organic vapors into the room when fabrics having higher concentrations of organics are being dried.

In accordance with the present invention, a device is provided which includes a duct through which gas may be withdrawn from the oven, a heater for heating the gas which has been withdrawn from the oven, a catalyst bed through which the heated gas may be passed, a differential thermocouple for measuring the temperature difference between the gas entering the catalyst bed and the gas leaving the catalyst bed, means for drawing the gas through the duct and the catalyst bed, and means for controlling the amount of air drawn through the oven in response to variations in the temperature difference between the gas entering and leaving the catalyst bed.

FIG. 1 is a schematic illustrating the relationship between the various elements of the system.

In FIG. 1, fabric 20 is shown being drawn through oven chamber 22 which is heated by burner 24. Natural gas or other suitable fuel enters burner 24 through gasline 26 where it is mixed with the air from air entrance 28 and the heated gas is discharged into the oven chamber 22 through burner discharge duct 30. The gas which enters through burner discharge duct 30 mixes inside oven chamber 22 with air which enters through fabric entrance slot 32 and fabric exit slot 34. Gas is exhausted from the interior of oven chamber 22 through exhaust pipe 36 by fan 37 which has sufficient capacity to prevent the discharge of an excessive amount of organics into the room when those fabrics which have the highest concentration of organics normally encountered are being dried. The amount of gas which is exhausted through discharge duct 36 can be controlled by damper 38, which is controlled in response to the amount of hydrocarbons within oven chamber 22.

The amount of hydrocarbons within oven chamber 22 is determined by withdrawing gas from oven chamber 22 through sampling duct 40. In most operations, the temperature of the gases in the oven chamber 22 will be in the range of around 320° -380° F. By passing the withdrawn gas over sample heater 42, the temperature of the withdrawn gas can be raised to be in the range of 500° - 1200° F. The temperature to which the gases are raised will depend principally upon the type of catalyst used in catalyst bed 44. The temperature must be sufficient to allow significant reaction to occur when the gases pass over catalyst bed 44. It is not necessary that the reaction go to completion but only that a measurable temperature difference be obtained over catalyst bed 44. However, it is preferred that the reaction go to completion because, in that case, the temperature difference between the gases entering and leaving the catalyst bed becomes relatively independent of the temperature at which the gases enter the catalyst bed. For this reason, it is preferred that the amount of catalyst provided be sufficient to completely combust the organics in the stream of gas which is withdrawn from the oven and the temperature to which the gases are raised be sufficient to ensure complete combustion when this amount of catalyst is used.

Means for drawing the gases out of the oven chamber over the heater and through the catalyst bed are provided. Such means may include a jet pump 50. For convenience, return duct 51 is provided to discharge the reacted gas back into the oven chamber. The temperature difference brought about by passing the gas through the catalyst bed can be measured by arranging the two junctions 46 and 48 of a differential thermocouple in the gas flow stream with cold junction 46 upstream of catalyst bed 44 and hot junction 48 downstream of catalyst bed 44. By connecting the like metals of juctions 46 and 48 together and by connecting the other two terminals to the controller, the system can be made responsive to the temperature difference across catalyst bed 44. For example, if an iron constantin thermocouple is used, the iron sides of the junctions would be connected together and the constantin sides of the junctions would be connected to the input of the controller. In this manner, controller 54 can be made responsive to the temperature difference across catalyst bed 44. Of course, the constantin sides of the junctions could be connected together and the iron leads connected to controller 54 to achieve the same effect.

In operation, the controller is adjusted so that for a small temperature gain between the two thermocouple junctions 46 and 48, the exhaust rate is as low as is consistent with safe operation of the oven. The magnitude of this temperature gain can be found empirically by the following procedure: the exhaust rate is reduced to the minimum, fabrics containing varying degrees of organic materials are passed through the oven as it operates, when the level of discharge of organic vapors into the room becomes sufficient to justify reducing the efficiency of the oven, the zero point of the controller is adjusted to begin opening the damper. The sensitivity or gain of the controller is then adjusted so that the discharge of organics into the room is maintained at an acceptable level for fabrics having the maximum expected amount of organics.

The type and amount of catalyst which should be used depends upon the temperature to which electric heater 42 raises the temperature of the gas which is withdrawn from the oven. In the most preferred embodiment, the amount of catalyst will be sufficient to completely combust the organics in the stream of gas which has been withdrawn from the oven. For example, if 5 standard cubic feet per minute of a gas containing up to 0.2 percent by weight of the organics typically found in undried textiles are to be withdrawn from the oven, and if this gas is to be heated to 600° F., then the total surface area of the platinum catalyst should be at least about .5 square feet. The maximum amount of catalyst which can be used is limited only by the need to keep the energy loss from the gas flowing through the catalyst bed to the environment within reasonable limits and the need to keep the pressure drop of the gas flowing through the catalyst bed within reasonable limits. The most preferred catalyst for use in the present invention is a platinum catalyst coated on a ceramic honeycomb sold by E. I. duPont de Nemours & Company under the tradename Torvex P-3. This catalyst has a 1/16th inch cell size and 462 square feet of surface area per cubic foot of catalyst. Any other suitable catalyst can be used including catalysts of the type used in automotive emission control systems; however, the temperature to which the gas must be raised may vary.

As our invention, we claim:

1. An apparatus for controlling the exhaust rate from a drying oven comprising:

means for exhausting gas from said oven;

sampling duct means opening into the interior of said oven for withdrawing gas from the interior of said oven;

heater means operably connected to said sampling duct means for heating the gas withdrawn from the interior of said oven;

catalyst bed means operably connected to said sampling duct means for combusting the organic material in the heated gas which is withdrawn from the interior of said oven;

temperature difference measuring means operably associated with said catalyst bed means for measuring the temperature difference between the gas entering the catalyst bed means and the gas leaving the catalyst bed means; said temperature difference measuring means including a thermocouple having a first junction disposed within said sampling duct means upstream of said catalyst bed means but downstream of said heater means and a second junction downstream of said catalyst bed means;

controller means operably associated with said means for exhausting gas and said temperature difference measuring means for varying the rate at which gas is exhausted in response to the temperature difference across said catalyst bed means;

discharge duct means operably associated with said catalyst bed means for discharging the gas withdrawn from the oven; and means for drawing gas through said sampling duct means, said catalyst bed means and into said discharge duct means.

2. Apparatus according to claim 1 wherein said heater means includes an electric resistance heater disposed within said sampling duct means.

3. Apparatus according to claim 1 wherein said means for drawing gas through said sampling duct means includes a jet pump disposed within said discharge duct means.

4. Apparatus according to claim 1 wherein said catalyst bed means includes a platinum on ceramic honeycomb catalyst, the quantity of said catalyst being sufficient to substantially combust the organics in the gas withdrawn from said drying oven.

5. Apparatus according to claim 1, wherein:

said heater means includes an electric resistance heater disposed within said sampling duct means;

said means for drawing gas through said sampling duct means includes a jet pump located in said discharge duct; and said catalyst bed means includes a platinum on ceramic honeycomb catalyst, the quantity of said catalyst being sufficient to substantially completely combust the organics in the gas withdrawn from said drying oven.

* * * * *